US008130161B2

(12) United States Patent
Arvidsson et al.

(10) Patent No.: US 8,130,161 B2
(45) Date of Patent: Mar. 6, 2012

(54) ANTENNA CONTROL SYSTEM

(75) Inventors: Per-Anders Arvidsson, Solna (SE); Olov Ekervik, Vallentuna (SE); Torbjörn Lindh, Huddinge (SE); Tord Liljevik, Bromma (SE)

(73) Assignee: Powerwave Technologies Sweden AB, Kista (SE)

( * ) Notice: Subject to any disclaimer, the term of this patent is extended or adjusted under 35 U.S.C. 154(b) by 647 days.

(21) Appl. No.: 11/791,378

(22) PCT Filed: Nov. 25, 2005

(86) PCT No.: PCT/SE2005/001777

§ 371 (c)(1),
(2), (4) Date: Jul. 6, 2009

(87) PCT Pub. No.: WO2006/057613

PCT Pub. Date: Jun. 1, 2006

(65) Prior Publication Data

US 2008/0036670 A1 Feb. 14, 2008

(30) Foreign Application Priority Data

Nov. 26, 2004 (SE) ..... 0402879

(51) Int. Cl.
*H01Q 3/00* (2006.01)

(52) U.S. Cl. ..... 343/757; 343/853; 342/374

(58) Field of Classification Search ..... 343/757, 343/765, 766, 853; 342/372–374
See application file for complete search history.

(56) References Cited

U.S. PATENT DOCUMENTS

| | | | | |
|---|---|---|---|---|
| 3,277,481 | A | 10/1966 | Robin et al. | |
| 5,801,600 | A | 9/1998 | Butland et al. | |
| 6,198,458 | B1 | 3/2001 | Heinz et al. | |
| 6,590,546 | B2 * | 7/2003 | Heinz et al. | 343/853 |
| 6,600,457 | B2 * | 7/2003 | Heinz et al. | 343/853 |
| 7,145,515 | B1 * | 12/2006 | Kim | 343/766 |
| 2006/0066494 | A1 | 3/2006 | Trejtnar et al. | |

FOREIGN PATENT DOCUMENTS

| | | |
|---|---|---|
| JP | H5-37222 | 2/1993 |
| JP | H5-121915 | 5/1993 |
| WO | WO 96/37922 | 11/1996 |
| WO | WO 0235651 A1 | 5/2002 |
| WO | WO 02061877 A2 | 8/2002 |
| WO | WO 2004/077611 A1 | 9/2004 |

OTHER PUBLICATIONS

PCT International Search Report and Written Opinion for International Application No. PCT/SE2005/001777 dated Jan. 3, 2006.
Peter Strickland, Ph.D., "Microstrip Base Station Antennas for Cellular Communications", IEEE Journal, 1991, pp. 166-171.

* cited by examiner

*Primary Examiner* — Hoang V Nguyen
(74) *Attorney, Agent, or Firm* — OC Patent Law Group

(57) ABSTRACT

An antenna control system in which various antenna elements in a vertical row are coupled by fixed transmission lines to a central feeding point for a common signal. Adjustment of the phase of the common signal is achieved by means of a linearly movable slide having dielectric body portions influencing the signal velocity along said fixed transmission lines. Further, an electrical motor is used for linearly displacing said movable slide with said dielectric body portions.

16 Claims, 4 Drawing Sheets

ANTENNA CONTROL SYSTEM

This application is a 371 of PCT/SE05/01777 dated Nov. 25, 2005.

FIELD OF THE INVENTION

The present invention relates to antenna control system for remote setting the tilt angle of an antenna. More particularly, the system is of the kind defined in the preamble of claim 1.

BACKGROUND OF THE INVENTION AND RELATED PRIOR ART

Today, mobile telephone systems usually are cellular systems, in which each cell in the system has at least one corresponding associated base station with at least one antenna for transmitting and receiving signals to/from e.g. user terminals of the system.

The base station antennas are designed such that the inclinational angle of the beam radiated from such an antenna generally is deflected downwardly with an angle relative to a horizontal plane in order to define a specific cell size. However, due to e.g. geographical topology and/or presence of buildings, the cell size in the system may vary, and so may the mounting height of the base station antennas. Therefore, the deflection angle, hereinafter referred to as downtilt angle, of the various antennas in the system must be set to different angles depending on the size of the particular cell in which the antenna is located, as well as the mounting location of the antenna.

The cell size, and thus also the downtilt angle, may also vary with varying kinds of cellular mobile telephone systems since different systems use different frequency ranges, and depending on the specific frequency range that is used, cell sizes have to be varied to provide a sufficient communication capacity.

The base station antennas are usually provided with a plurality of radiating elements arranged on a vertical row, and to vary the downtilt angle, a phase angle difference between the radiating elements is imposed on a common signal fed to the radiating elements, wherein the phase angle differences between any two elements is the same. This results in a composite beam from the plurality of radiating elements that will always have a wave front substantially in the form of a straight line. The inclination angle may further be adjustable, for example by means of phase shifters, by adjusting the phase angle difference between the radiating elements.

Today, adjustment of the phase shifters often requires that adjustment is carried out manually directly on or at the antenna, usually by maneuvering an operating element such as knob or a rod. Maneuvering the knob or rod may then actuate phase shifting means to relatively change the phase angle difference between signals fed to the radiating elements and thus the downtilt angle. There also exists, however, systems where the downtilt angle may be controlled from a remote location, e.g. by sending commands from a central operation and maintenance centre to control electronics associated with operating element actuating means, such that the control logic may translate e.g. a SET TILT=15° command to relative movement of the operating element actuator to perform a corresponding movement of the operating element, thus causing the phase shifting elements to effect a phase shift resulting in the desired down tilt angle.

One such system is previously known from the document EP EP1356539 (Kathrein Werke KG). EP1356539 discloses an antenna control apparatus as well as an associated antenna.

The control apparatus has control electronics and an electric motor. The antenna control apparatus is arranged such that it can be retrofitted outside the protective cover of a base station antenna and engage an operating element, which is passed out of the interior of the antenna via an operating opening, or be introduced into the interior of the protective cover via this operating opening. Alternatively, the control apparatus may be fitted as a preferably complete unit underneath the protective cover of the antenna. The possibility of retrofitting a control apparatus is desirable since it makes it possible to modify existing antennas at existing base stations with only manual downtilt possibilities so as to enable remote downtilt control of those antennas.

One problem with existing remote tilt systems, however, is that the phase shifters that are used in remote tilt systems are rather complex and use mechanical solutions which require a substantial torque to manoeuvre the operating element.

AIM AND MOST IMPORTANT FEATURES OF THE INVENTION

It is an object of the present invention to provide an antenna control system for remote setting the tilt angle of an antenna that solves the above mentioned problem.

This object is achieved by an antenna control system according to the characterizing portion of claim 1.

The antenna control system for remote setting of the tilt angle of an antenna according to the present invention is characterized in that various antenna elements in a vertical row are coupled by fixed transmission lines to a central feeding point for a common signal, and that the adjustment of the phase of the common signal is achieved by means of a linearly movable slide having dielectric body portions influencing the signal velocity along said fixed transmission lines. Further, an electrical motor is used for linearly displacing said movable slide with said dielectric body portions. This has the advantage that a solution without complex mechanical structures is obtained, whereby a relatively low torque of the electric motor is necessary to move the slide, which thus enables use of a lower-powered motor and, correspondingly, lower-powered motor drive circuits. Further, the use of such a phase shifter has the advantage that the risk of mechanical malfunctioning due to e.g. varying weather conditions substantially is reduced.

The electric motor and its associated control electronics may comprise a complete unit or complete module. This has the advantage that the module can be retrofitted to the antenna. As an alternative, said unit or module may be arranged to be mounted within the environmental protection (protective cover) of the antenna.

The electric motor and its associated control electronics may be accommodated in a separate housing arranged to be secured to the antenna outside the environmental protection (protective cover) of the antenna. Said housing may be arranged such that it can be retrofitted to the antenna, preferably without opening the environmental protection of the antenna. This has the advantage that the module can be retrofitted to the antenna as a separate unit with an own protective cover separated from the protective cover of the antenna.

The communication system may be any from the group: GSM system, UMTS system, AMPS system, a TDMA and/or CDMA and/or FDMA system.

These and other features of the invention will become apparent from the detailed description below.

The invention will be explained more fully below with reference to the appended drawings illustrating exemplary embodiments.

DETAILED DESCRIPTION OF EXEMPLARY EMBODIMENTS

Figure 1:
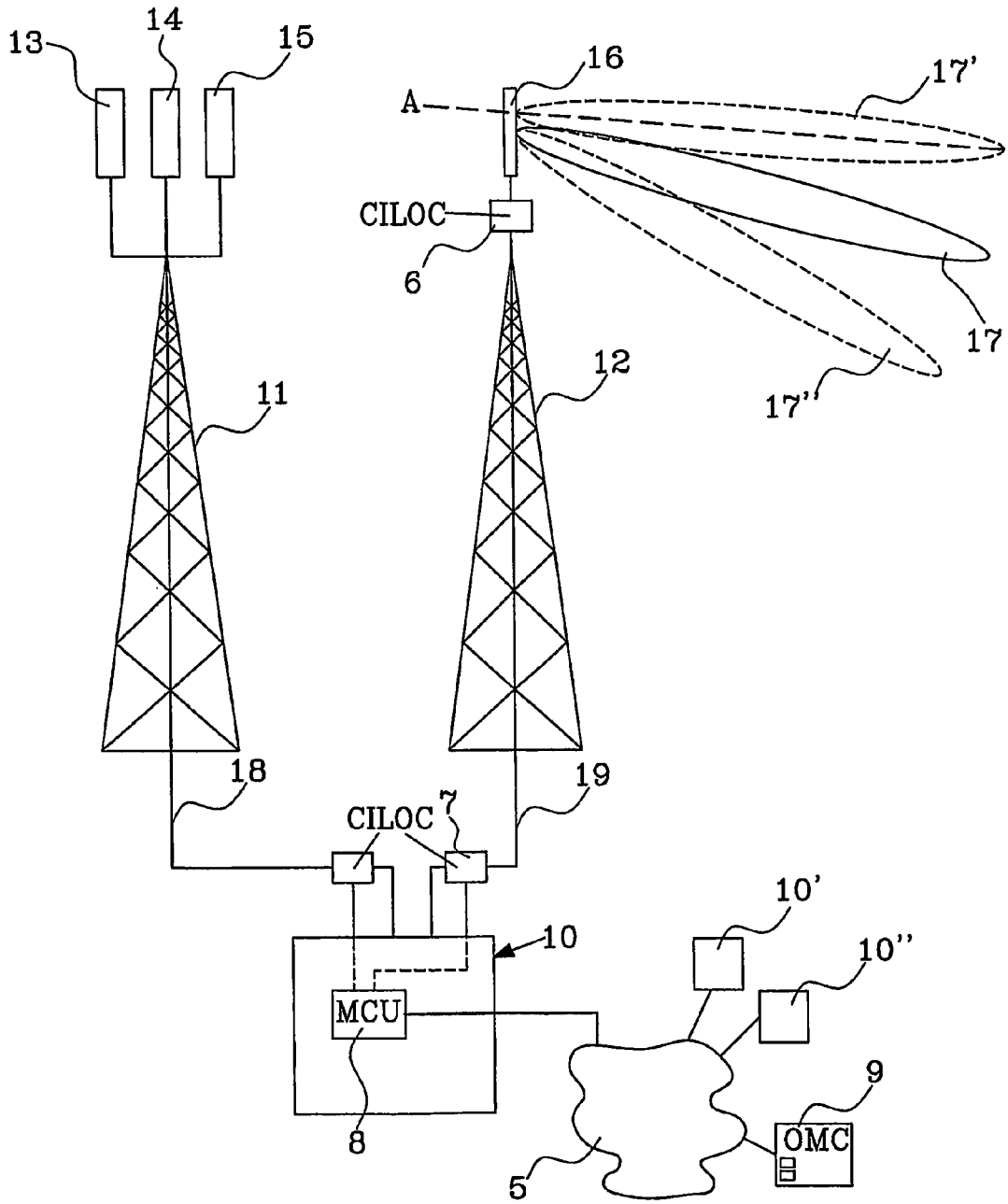
FIG. 1 shows part of a cellular communication system implementing the present invention.

In FIG. 1 is shown part of a cellular communication system implementing the present invention. The figure shows a base station 10 with two antenna frame structures, such as towers 11, 12. Three antennas 13, 14, 15 are mounted to the tower 11, while only one antenna 16 is mounted to the tower 12. Each antenna 13-16 transmits signals in a main lobe, of which only the main lobe 17 of antenna 16 is shown. In the figure, the main lobe 17 is directed slightly downwards. By use of phase shifting means, the main lobe 17 may, and, of course, in a similar manner main lobes of the antennas 13-15, independently of other main lobes be tilted up or down in a certain angle range relative to a horizontal plane A. This is indicated by upper and lower main beams 17' and 17". The angle range may e.g. be from 0° to 90°. Other angle ranges may, however, of course equally well be utilized.

The antennas are driven via feeder cables, such as coax cables 18 and 19 connecting the antennas to the base station 10, and which are used to provide the antennas with signals to transmit, and to provide the base station with signals received by the antennas.

In a system utilizing remote setting of the tilt of a beam of an antenna, the tilt angle may be set, e.g. from an operation and maintenance centre (OMC) 9, which is connected to a plurality of base stations (indicated as 10', 10"), e.g. via an Ethernet network 5 such as the Internet or a Local Area Network. Alternatively, the OMC 9 may be connected to the base station(s) via e.g. a modem connection. When an OMC operator, or an OMC computer performing automatic supervising of the communication system, decides that the tilt angle of antenna 16 should be altered, a command such as e.g., SET TILT=22° is generated. If the command is generated by an operator, the command may be generated via e.g. a keyboard. Alternatively, the command may be automatically generated by a supervising computer. The generated command is transmitted to a control unit, such as a Master Control Unit (MCU) 8, in the base station. As an alternative, a MCU 8 may be mounted to each tower. If a single MCU 8 located in the base station is used, this MCU may be shared by a plurality of towers. The set tilt command may be transmitted to the MCU via an Ethernet network, e.g. by the TCP/IP protocol.

In the MCU 8, the set tilt command is converted to a format suitable for use by control electronics located near the antenna, and is transmitted to the control electronics, e.g. as a signal superposed on the feed line signals and preferably via the AISG protocol, which is incorporated herein by reference. If the signals are superposed on the feed line signals, this may be accomplished by using a CILOC 7 (Current Injector Layer One Converter) near the base station and a second CILOC 6 near the antenna. Alternatively, the command signals to the antenna unit may be transmitted to the control electronics via a direct link from the MCU 8 to the control electronics. The control signals may further be transmitted to the control electronics via a wireless interface.

Figure 2:
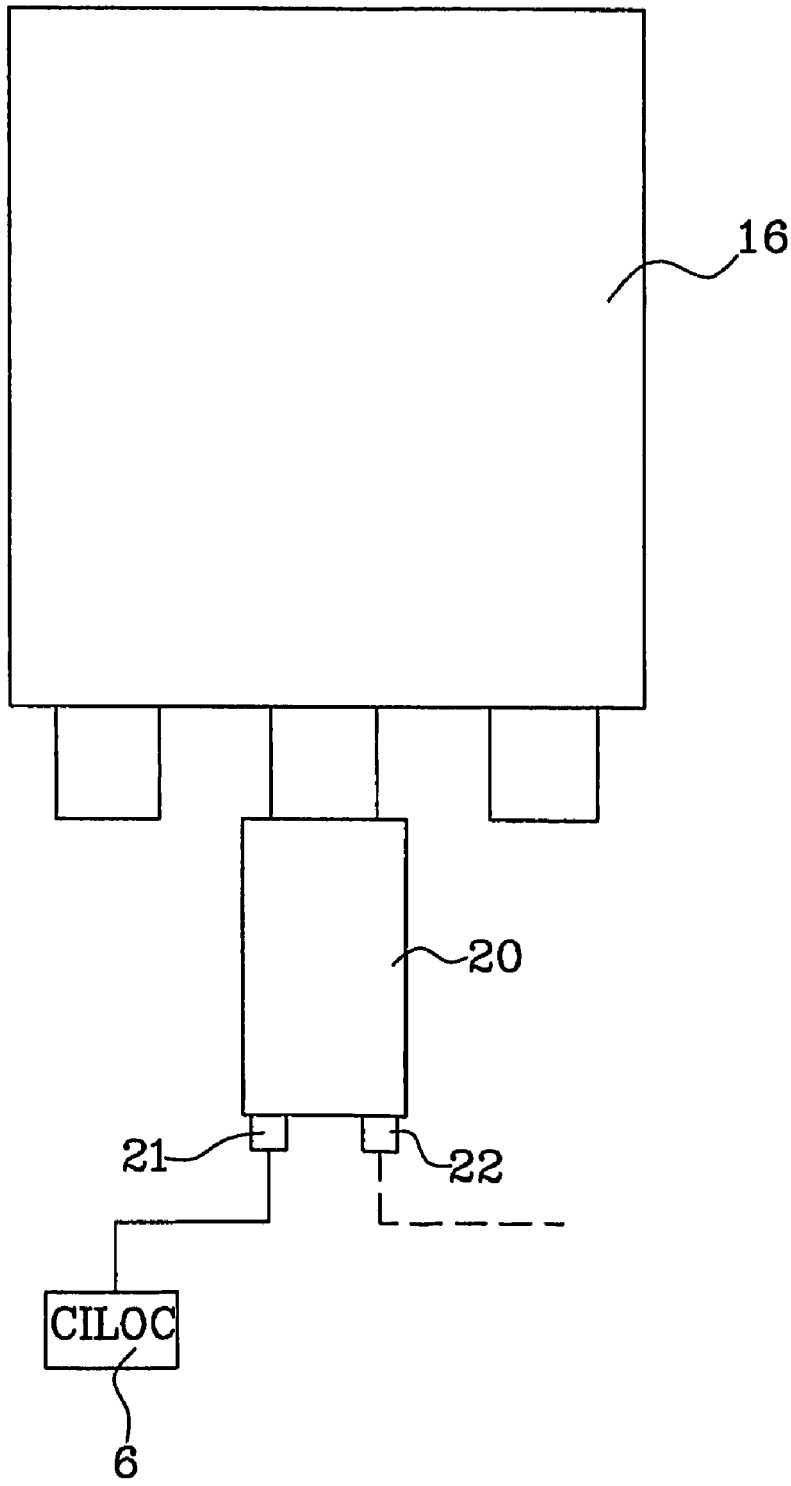
FIG. 2 shows a lower portion of a protective cover of an antenna, and a housing comprising the control electronics.

The operation of the control electronics will be described more in detail with reference to FIGS. 2 and 3. In FIG. 2 is shown the lower portion of the protective cover of the antenna 16 and a housing 20 comprising the control electronics and an electric motor such as a stepping motor. The lower portion of the housing comprises a connection 21 for connecting a cable from the upper, rightmost CILOC 6 in FIG. 1. If more than one antennas are mounted to the tower, such as the antennas 13-15, the housing may comprise a second connection 22 for providing the signals to the control electronics of the other antennas.

Figure 3:
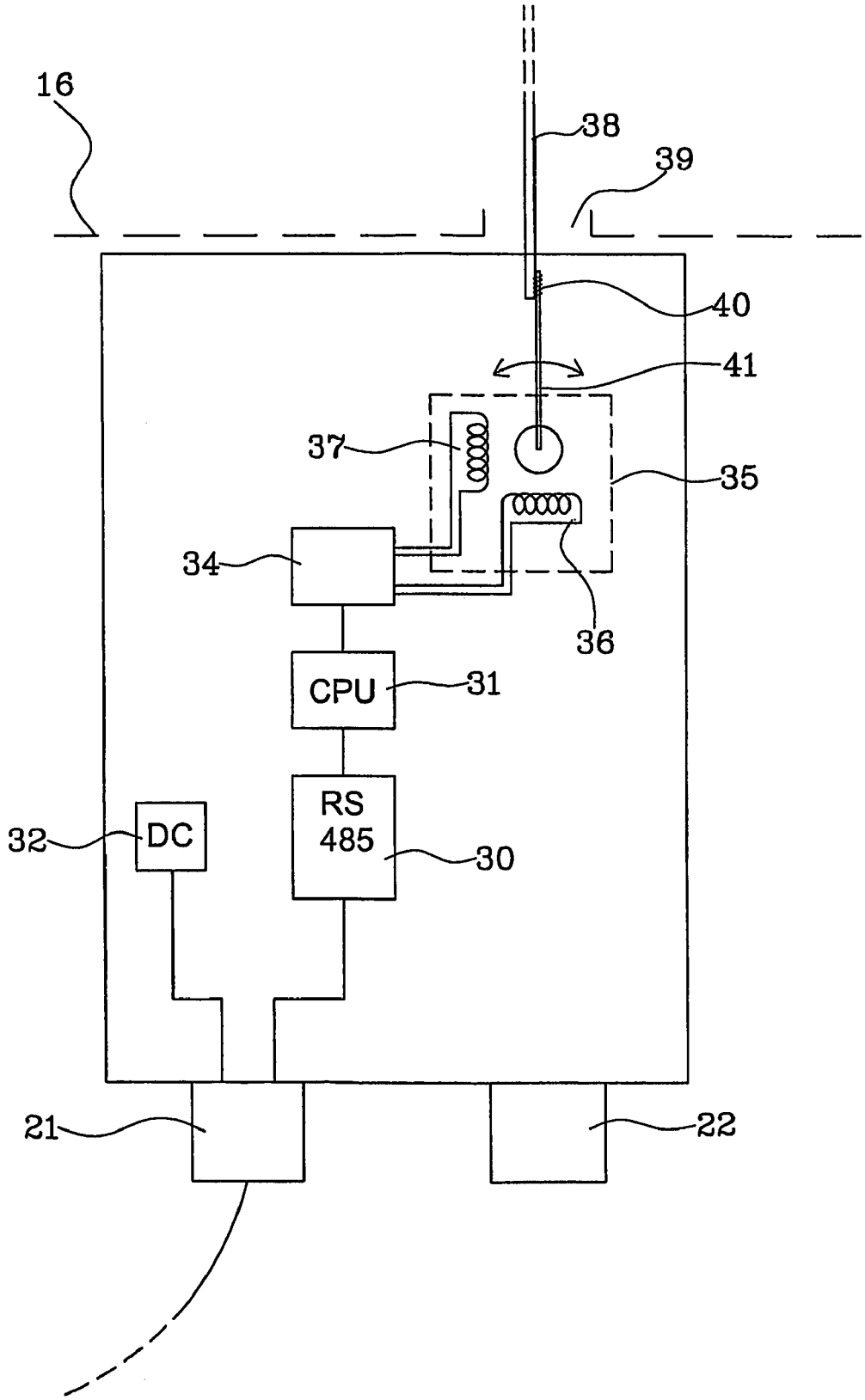
FIG. 3 shows the contents of the housing in FIG. 2 more in detail.

The content of the housing 20 is shown more in detail in FIG. 3. The signal received from the CILOC 6 is used to power the control electronics and the electric motor via a DC module 32. Further, a receiving circuit, such as a RS485 circuit 30 used in the AISG standard, monitors received signals and looks for an address of the antenna. If the receiving circuit 30 determines that a received command is intended for the particular antenna, the command is converted to a CPU readable format and transmitted to the CPU 31 via connection 33. The CPU converts the received command (e.g. the SET TILT=22° command) to drive signals of a stepping motor driver 34, which driver 34 actuates two linings 36, 37 of a stepping motor 35, which in turn actuates an operating element 38 of e.g. phase shifting means for imposing a relative phase shift so that the phase angle differences between any two radiating elements is the same.

In order to translate command signals into drive signals, type of antenna and/or a table including the relationship of lobe inclination vs. unit length of movement of the operating element or steps of the stepping motor, may be stored in a memory in, or connected to, the CPU. The data in this memory may further be replaced by other data, e.g. transmitted to the control electronics from the OMC.

The operating element may be extended through an operational opening 39 in the antenna housing 16, and be provided with teeth for engagement with a threaded portion 40 of a shaft 41 of the stepping motor 35, directly or via a gear coupling (not shown).

As mentioned above, a number of antennas may be provided on the same tower, and each antenna may be provided with a control apparatus as disclosed in FIGS. 2-3 in order to allow individual setting of each antenna. It is, however, also possible that there are a plurality of antennas, e.g. three antennas each covering a 120° sector, or six antennas each covering a 60° sector, which are to be controlled with identical commands. One control apparatus may then be used to control these antennas by controlling a plurality of stepping motors, e.g. by having a stepping motor driver able to provide drive signals to a plurality of stepping motors.

Figure 4A:
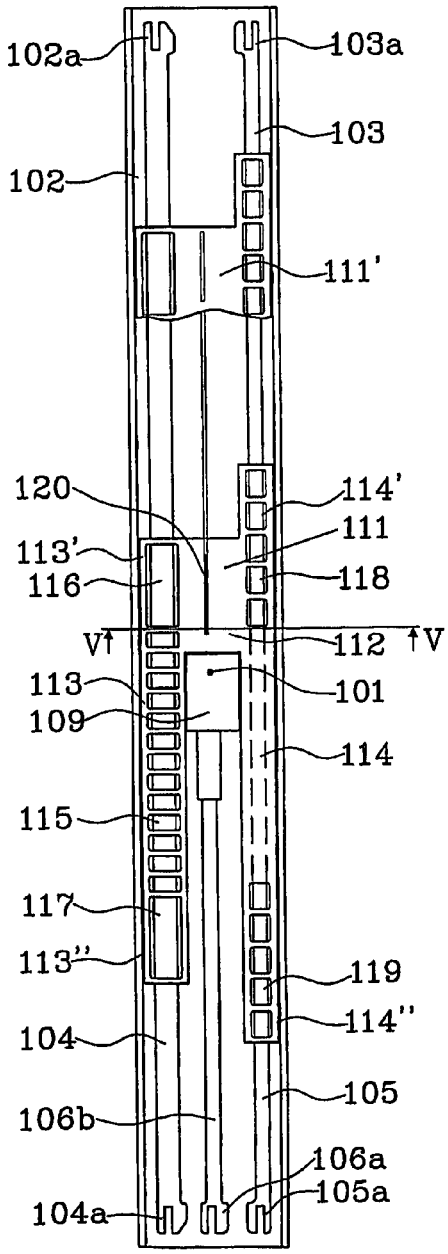
FIGS. 4*a* and 4*b* shows phase shifting means suitable for use with the present invention.
Figure 4B:
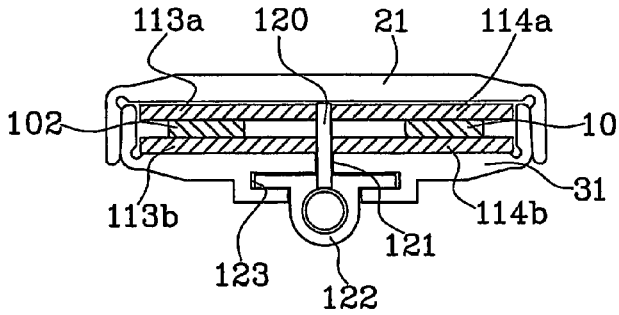

An example of dielectric phase shifting means, which advantageously can be used with the present invention, is shown in FIGS. 4*a* and 4*b*. The phase shifter in FIGS. 4*a* and 4*b* is explained more in detail in WO02/35651. In the illustrated embodiment is shown phase shifting means for providing phase shift to four radiating elements or sub-arrays, e.g. pairs of antenna elements, arranged in an array, normally a linear row. Each element is connected to a central source connection terminal via an associated feed connection terminal 102*a*, 103*a*, 104*a* and 105*a*, respectively, and straight line segments 102-105. The source connection terminal 101 is connectable to a signal source by means of a feed conductor 106, which is connected to a feed terminal 106*a*. In use, the feed terminal 106*a* is connected, e.g. via a coaxial cable, to transceiver circuits (not shown), e.g. included in the base station In order to achieve phase shifting, a displaceable dielectric body is used, as will be explained below.

A microwave signal appearing at the feed terminal 106*a* will propagate along the central feed conductor 106 to the centrally located source connection terminal 101. Adjacent to the terminal 101, there are upper and lower stationary dielectric elements 109, 110, aiding impedance matching of the four feed line segments 102-105. A unitary body 111 of dielectric material is arranged between the housing walls and the feed line segments 102, 103, 104, 105 so as to influence the propagation velocity and the phase shift of the signal components being transferred along the respective line segments. The dielectric body 111 is linearly displaceable along the longitudinal direction A between two end positions, one of which is the fully drawn position in FIG. 4*a* and the other being the one indicated by dashed lines 111'.

The dielectric body 111 includes two longitudinal side portions connected by a transverse body portion 112, namely a first body portion 113 and a second body portion 114.

The phase angle differences between the signal components at the feed connection terminals 102*a*, 103*a*, 104*a*, 105*a* will depend on the particular position of the dielectric body 111. When the dielectric body 111 is displaced a certain distance, all the phase shifts of the four signal components will be changed uniformly. Accordingly, the phase angle difference between the terminals associated with adjacent antenna elements (or sub-arrays) will always be mutually the same. Thus, the phase angle differences between the terminals 103*a* and 102*a*, between the terminals 102*a* and 104*a*, and between the terminals 104*a* and 105*a* will be equal to each other. Therefore, the composite beam from the four antenna elements coupled to these terminals will always have a wave front substantially in the form of a straight line, and the inclination of this wave front can be adjusted by displacing the dielectric body 111 to a different position in the longitudinal direction of the device.

As can be seen in FIG. 4*b*, a movement transfer member 120 is secured to the dielectric body 111 and extends through a longitudinal slot 121 in the bottom wall 31 of the housing 10. The member 120 is connected to a slide member 122, which is longitudinally guided in profiled grooves 123 formed at the lower side of the bottom wall 31. This slide member 122 may constitute, or be connected to, the operating element, whereupon the inclinational angle of the beam from the antenna can be adjusted as desired by operating the operating element.

The present invention thus presents a solution that allows remote control of an operating element to control the antenna down tilt, wherein a solution without complex mechanical structures is obtained, whereby the risk of overloading the electric motor is substantially reduced, and whereby the risk of mechanical malfunctioning due to e.g. varying weather conditions, such as large temperature differences and/or atmospheric humidity substantially is reduced. The present invention further has the advantage that the control electronics and the operating element actuator, e.g. the stepping motor, can be enclosed in a separate housing and be attached to the antenna housing in any suitable way, and thus allow retrofitting of control equipment to an existing antenna without the need to remove the antenna protective cover.

In the above description a stepping motor has been used. It is, of course, also possible to use other types of electric motors or other types of equipment that can perform a desired actuation of the operating element.

The invention claimed is:

1. An antenna control system comprising:

a remotely controllable antenna unit to be positioned at an elevated position at a frame structure adjacent to a base station in a cellular mobile telephone system, said antenna unit including at least one row of antenna elements, located at predetermined fixed positions along said row, being fed by a common signal for emitting and receiving microwave signals in a main lobe in a cell associated with said base station, the general angular direction of said main lobe being controllable by adjusting the phase of said common signal so as to achieve a predetermined phase difference of said common signal at the various antenna elements in said row, and electro-mechanical means for effecting said phase adjustment, wherein the various antenna elements in said row are coupled by fixed transmission lines to a central feeding point for said common signal, said adjustment of said phase of said common signal is achieved by means of a linearly movable operating element connected to dielectric body portions influencing the signal velocity along said fixed transmission lines, and said electro-mechanical means comprising an operating element actuator for linearly displacing said movable operating element with said dielectric body-portions, and control electronics including:

input means for receiving command signals transmitted from a remote control unit, means for determining if any received command signal is intended for the antenna unit, means for converting said command signal intended for the antenna unit into a corresponding control signal for said operating element actuator, and means for controlling said actuator based on the control signal in order to displace said linearly movable operating element with said dielectric body portions so as to make a corresponding adjustment of said phase of said common signal at each antenna element, thereby controlling the general angular direction of said main lobe.

2. Antenna control system according to claim 1, wherein said row of antenna elements is a vertical row of antenna elements, and that said main lobe is directed slightly downwardly towards the ground in a cell associated with said base station.

3. Antenna control system according to claim 1, wherein the means for determining if the command signal is intended for the antenna unit includes means for reading an address in an address field in the command signal.

4. Antenna control system according to claim 1, wherein a base station control unit is located at the base station and/or the frame structure, which base station control unit receives command signals from an operations control centre at a location remote from said base station and transmits the command signals to at least one antenna unit.

5. Antenna control system according to claim 4, wherein the base station control unit transmits the command signals to the antenna unit via a direct link or superposed on the antenna feed line(s).

6. Antenna control system according to claim 4, wherein the remotely located control centre transmits the command signals to the base station via an Ethernet network or a dial-up connection.

7. Antenna control system according to claim 1, wherein the control electronics further includes output means, and that there is a connection between the input means and the output means for passing on the command signals to further antenna units located at the frame structure.

8. Antenna control system according to claim 1, wherein the operating element actuator and its associated control electronics are accommodated in a separate housing arranged to be secured to the antenna outside a protective cover of the antenna.

9. Antenna control system according to claim 1, wherein the control electronics and the electric motor are arranged to be mounted within the environmental protection (protective cover) of the antenna.

10. Antenna control system according to claim 1, wherein the movement of the linearly movable operating element is achieved by a toothed pinion connected to the drive shaft of the operating element actuator and interengaging with teeth on the linearly movable slide.

11. Antenna control system according to claim 1, wherein the control electronics further includes means for determining the exact position of the linearly movable operating element, and thereby the exact angular direction of said main lobe.

12. Antenna control system according to claim 11, wherein said means for determining the exact position of the linearly movable operating element includes a hall element located on the toothed pinion, whereby the number of revolutions of the pinion may be determined, and thereby the linear displacement of the operating element.

13. Antenna control system according to claim 1, wherein the control electronics is used to control at least two antenna units by controlling at least two operating element actuators.

14. Antenna control system according to claim 1, wherein the control electronics further includes a memory arranged to store an antenna type and/or a table including the relationship of lobe inclination vs. unit length of movement of the movable operating element.

15. Antenna control system according to claim 1, wherein the dielectric body constitute part of a phase shifting device which is configured with at least four line segments extending from a source connection terminal to feed connection terminals, with:

at least a first line segment and a second line segment extending generally in a first direction along said main direction, at least a third and a fourth line segment extending generally in a second direction being opposite to said first direction, wherein said dielectric body having a first body portion located adjacent to said first and third line segments and having a first effective dielectric value, and a second body portion located adjacent to said second and fourth line segments and having a second effective dielectric value being different from said first effective dielectric value, and said dielectric body being linearly displaceable between two end positions while keeping said first and second body portions in proximity to the respective pair of oppositely extending line segments.

16. Antenna control system according to claim 1, wherein the operating element actuator is an electric motor, such as an electric stepping motor.

* * * * *